US005465956A

United States Patent [19]

Takemoto et al.

[11] Patent Number: 5,465,956

[45] Date of Patent: Nov. 14, 1995

[54] ENDLESS BELT BANK NOTE CONVEYING DEVICE WITH BALL SUPPORTS FOR THE BANK NOTES

[75] Inventors: Takatoshi Takemoto; Tosikazu Chida, both of Tokyo; Noriaki Kano, Hanamaki; Eizi Ito, Hanamaki; Koji Murakami, Hanamaki; Takasi Itagaki, Hanamaki; Kozo Sedimoto, Senda; Masanori Suzuki, Hanamaki, all of Japan

[73] Assignee: Kabushiki Kaisha Ace Denken, Japan

[21] Appl. No.: 321,120

[22] Filed: Sep. 29, 1994

[51] Int. Cl.[6] ..... B65H 5/02

[52] U.S. Cl. ..... 271/274; 271/273; 271/275; 271/198; 198/834; 198/840

[58] Field of Search ..... 271/272–275, 271/198; 198/834, 840

[56] References Cited

U.S. PATENT DOCUMENTS

| | | | |
|---|---|---|---|
| 3,703,626 | 11/1972 | Shanrock | 271/275 X |
| 4,145,039 | 3/1979 | Carlsson | 271/274 |
| 4,234,305 | 11/1980 | Miyake et al. | 271/198 X |
| 5,100,125 | 3/1992 | Uplinger et al. | 271/275 X |

FOREIGN PATENT DOCUMENTS

| | | | |
|---|---|---|---|
| 12249 | 2/1981 | Japan | 271/275 |
| 152755 | 9/1983 | Japan | 271/272 |
| 61-151945 | 9/1986 | Japan . | |

*Primary Examiner*—H. Grant Skaggs
*Assistant Examiner*—Carol L. Druzbick
*Attorney, Agent, or Firm*—Andrus, Sceales, Starke & Sawall

[57] ABSTRACT

A conveying device prevents slip or disengagement of a conveying endless belt. The belt has an flat outer periphery, which is to be contact with one of the major faces of the bank note to be conveyed, and an inner periphery having a plurality of teeth formed thereon. A drive pulley and a driven pulley are both cylindrical and have a plurality of gear teeth formed on their outer peripheries. The teeth of each of the pulleys may be engageable with the plurality of teeth of the endless belt. Between the drive pulley and the driven pulley, the endless belt is tensioned and a belt drive mechanism for rotating the drive pulley is provided. Each pulley has a flange which has a larger outer diameter than that of each pulley and provided at one end portion thereof in which each of the rotary shaft extends.

4 Claims, 11 Drawing Sheets

ENDLESS BELT BANK NOTE CONVEYING DEVICE WITH BALL SUPPORTS FOR THE BANK NOTES

BACKGROUND OF THE INVENTION

1. Field of the Invention

The present invention relates to a bank note conveying device for conveying bank notes, and more particularly to a bank note conveying device in which the rotation of a drive pulley is effectively transmitted to an endless belt thereby conveying a bank note more effectively.

2. Description of the Related Art

A conventional bank note conveying device is disclosed, for example, in Japanese Utility Model Kokai Sho 61-151945.

This bank note conveying device consists of an endless belt having a circular cross section; a drive pulley and a driven pulley between which the endless belt is tensioned, both being cylindrical in shape with a smooth outer periphery; and a plurality of small pulleys placed along the endless belt. In the bank note conveying device, the bank note is held between the endless belt and the small pulleys and conveyed according to the rotation of the endless belt.

However, in the conventional art, as the bank note is not conveyed by simply being disposed on a normal flat belt, but conveyed by being held between the endless belt and the small pulleys, an external force acts to stop the endless belt between the driven pulley and the drive pulley. Especially in order to convey the bank note at the same speed as the movement of the endless belt, the small pulleys must be pressed against the endless belt with a fairly strong force. Accordingly, the external force acting to stop the endless belt will increase greatly. This makes the endless belt slippery with respect to the drive pulley preventing effective transmission of the driving force of the drive pulley to the endless belt and smooth and effective conveyance of the bank note.

SUMMARY OF THE INVENTION

The present invention was made with a view to obviating the problems found in the prior art as mentioned above. It is therefore an object of the present invention to provide a bank note conveying device in which the bank note may be conveyed effectively.

To accomplish the aforementioned object, the present invention provides a bank note conveying device comprising:

an endless belt having a flat outer periphery which is to be in contact with one of the major faces of a bank note to be conveyed and an inner periphery having a plurality of teeth formed thereon;

a drive pulley and a driven pulley, both being cylindrical and having a plurality of gear teeth formed on their respective outer peripheries so that they may engage with the plurality of teeth of the endless belt;

the endless belt being tensioned between the drive pulley and the driven pulley;

a rotary shaft penetrating the center of each of the cylindrical pulleys;

a belt driving mechanism for rotating the rotary shaft of the drive pulley;

a plurality of balls which are placed along the endless belt and are to be in contact with another major face of the bank note; and ball holders for rotatably supporting the balls respectively.

In the bank note conveying device as mentioned above, the bank note is held between the balls and the endless belt, and conveyed according to the rotation of the endless belt. As a plurality of teeth are formed on the inner periphery of the endless belt and on the outer peripheries of each of the pulleys, the endless belt will not slip with respect to each of the pulleys.

Preferably, the drive pulley and the driven pulley have a flange having a larger outer diameter than that of each pulley provided on at least one end portion thereof in the direction each rotary shaft extends so that the endless belt may not slip off. Besides, in the case that a plurality of cylindrical belt supporting pulleys having a plurality of gear teeth on the outer periphery are provided at the positions opposing to the plurality of balls, it is preferable that each of the belt supporting pulleys has a flange having a larger diameter than the outer diameter of the belt supporting pulley on at least one end portion thereof in the direction its rotary shaft extends so that the endless belt may not slip off. When a flange for preventing the endless belt from slipping off is provided for each pulley, the position of the endless belt is regulated by the flange, and the endless belt will not slip off.

DESCRIPTION OF THE PREFERRED EMBODIMENT

Figure 12:
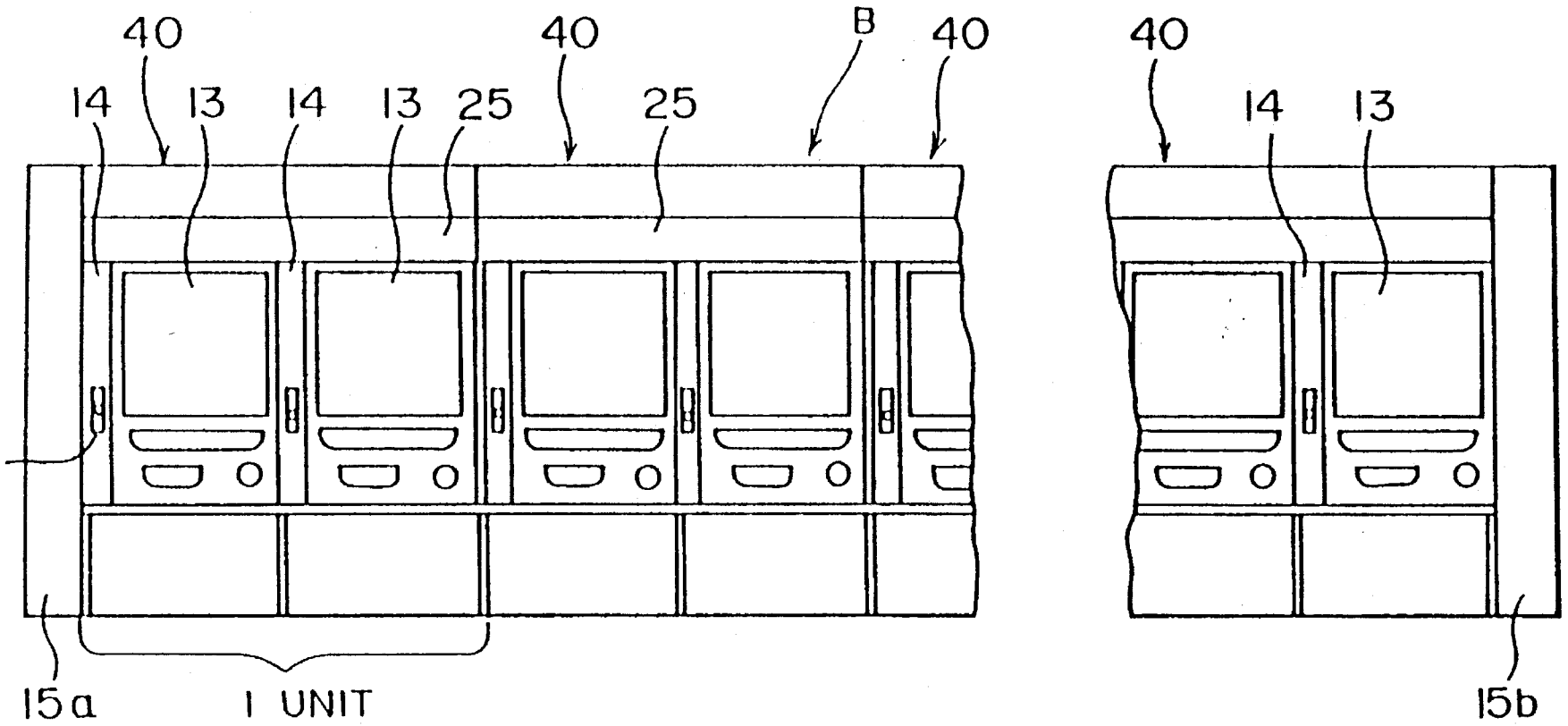
FIG. 12 is a front view of a Pachinko game island which the embodiment of the present invention is applied.

An embodiment of the present invention will now be explained. As shown in FIG. 12, a Pachinko game island B consists of a plurality of pachinko game machines 13, 13 . . . a plurality of pachinko ball lending machines 14, 14 . . . and island decorations or trim 15*a*, 15*b*. The pachinko game machines 13, 13 and the pachinko ball lending machines are aligned, alternately in series to form a pachinko game machine row. In one pachinko game island B, two pachinko game machine rows are provided in parallel to each other with the machines in the two rows arranged back to back. As FIG. 12 is a front view of the pachinko game machine island, only one row of pachinko game machines can be seen in the figure.

Figure 10:
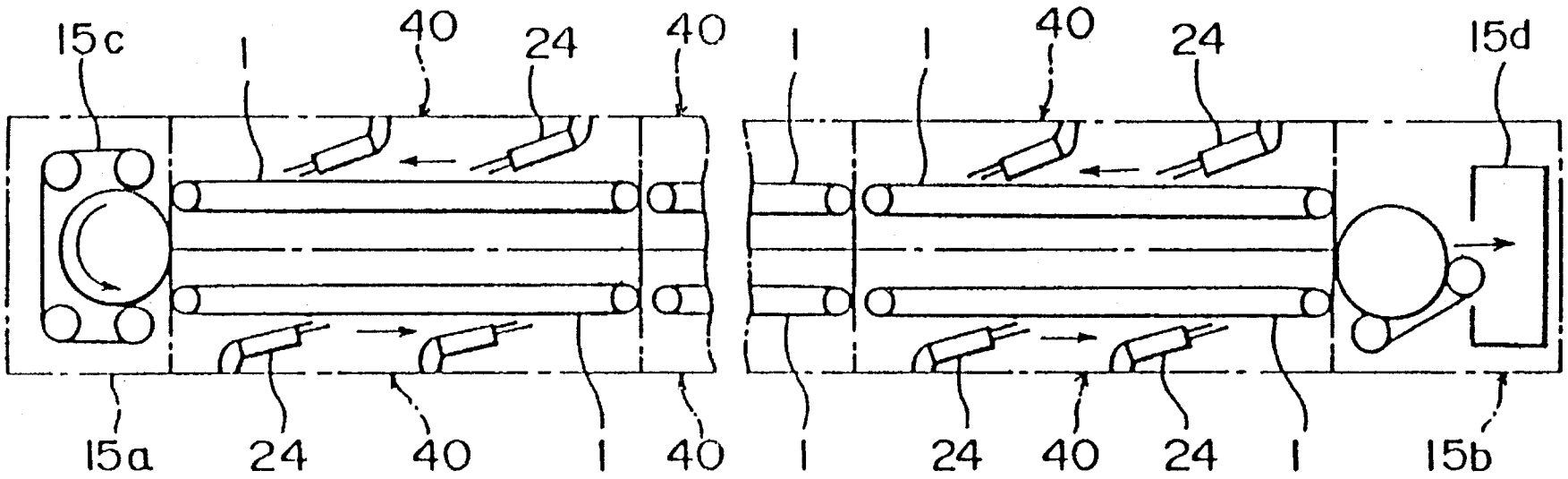
FIG. 10 is an explanatory view showing the arrangement of the bank note conveying unit and island decorations according to the embodiment of the present invention.

At the opposite ends of the two pachinko game machine rows, the island decorations 15*a* and 15*b* are provided respectively. In the pachinko game machine island B, each set of two pachinko game machines 13 and two pachinko ball lending machines 14 constitutes one unit. On each of the pachinko game island rows, a plurality of conveying units 40 are disposed, each including a bank note conveying device, a bank note distinguishing device, a coin conveying device, and a coin distinguishing device. Therefore, as shown in FIG. 10, the plurality of conveying units 40 are arranged in two lines. In each line, the units 40 are aligned in series, adjoining to each other. In the island decoration 15*b* provided at one end portion of the pachinko game island B, a money exchange 15*d* is installed. In the money exchange 15*d*, there is provided stackers for respectively storing bank notes and coins, which were conveyed respectively by the bank note conveying device and the coin conveying device in the conveying unit 40. In the island decoration 15*a* located at another end of the pachinko island, there is provided a turning device 15*c* which transfers bank notes and coins conveyed to the end of one pachinko game island row to the other pachinko game machine row.

Figure 11:
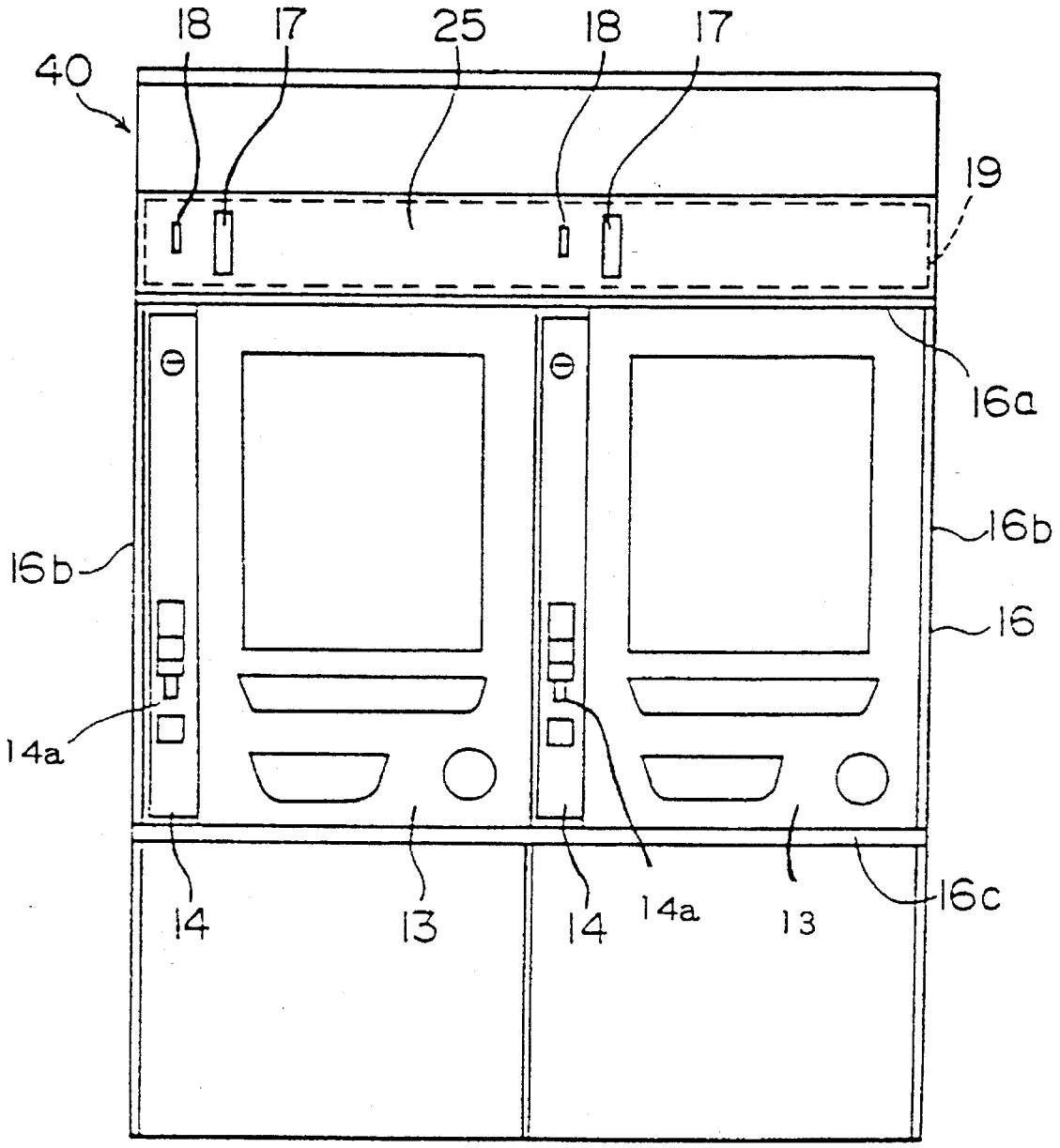
FIG. 11 is a front view showing pachinko game machines and pachinko ball lending machines forming a unit and employable in the embodiment of the present invention.

As shown in FIG. 11, the pachinko game machines 13, 13 and the pachinko ball lending machines 14, 14 which constitute one unit are accommodated in a rectangular unit support frame 16. The unit support frame 16 consists of a top board 16*a*, side boards 16*b*, 16*b*, and a waist board 16*c*. On the top board 16*a* of the unit support frame 16, a conveying base 19 for the conveying unit 40 is disposed. In the front side of the conveying base 19, there is provided a front covering board 25 In the front covering board 25 a bank note inserting slot 17 and a coin inserting slot 18 are formed.

Figure 1:
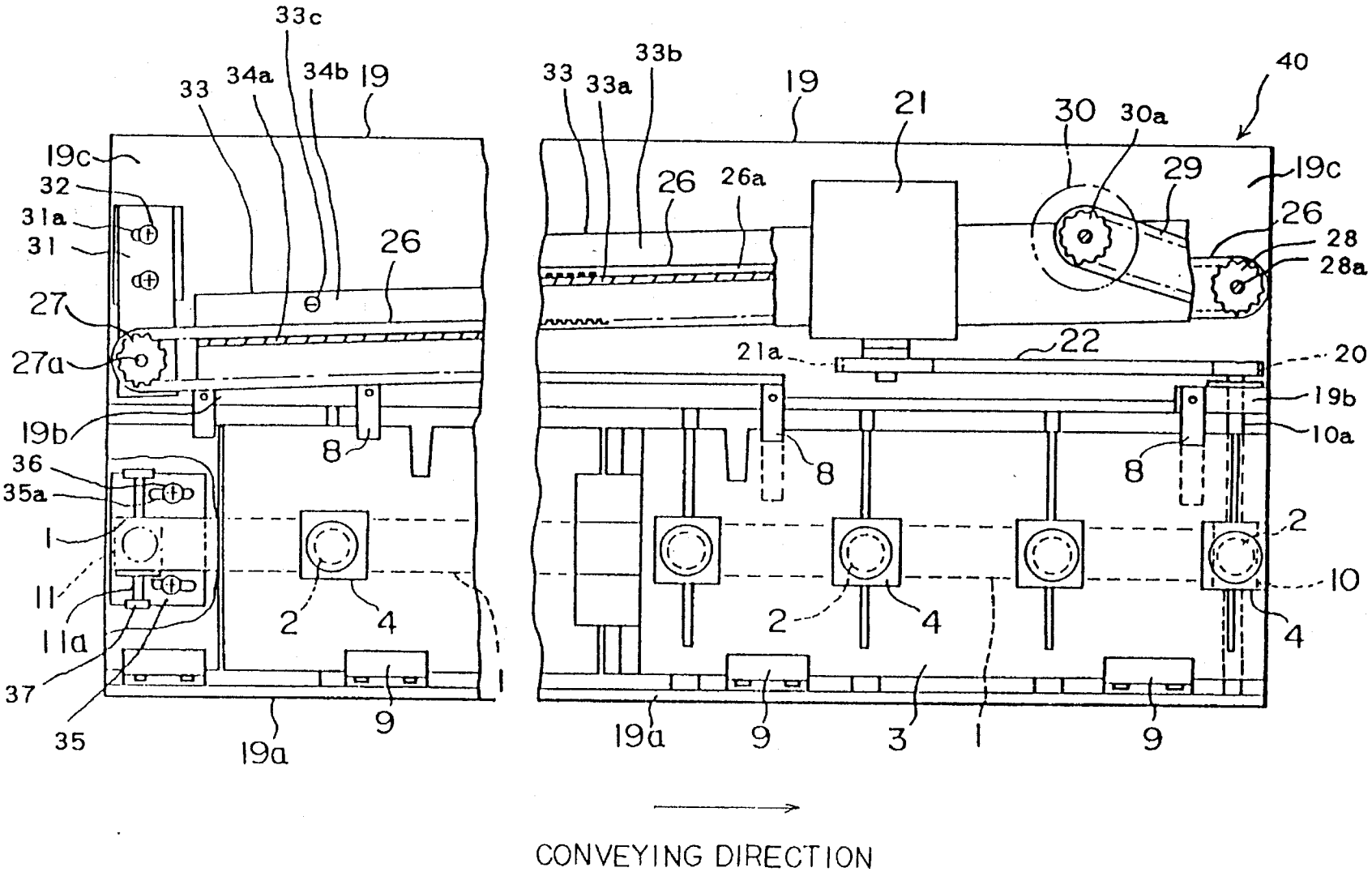
FIG. 1 is a front view of the bank note conveying unit according to an embodiment of the present invention.
Figure 2:
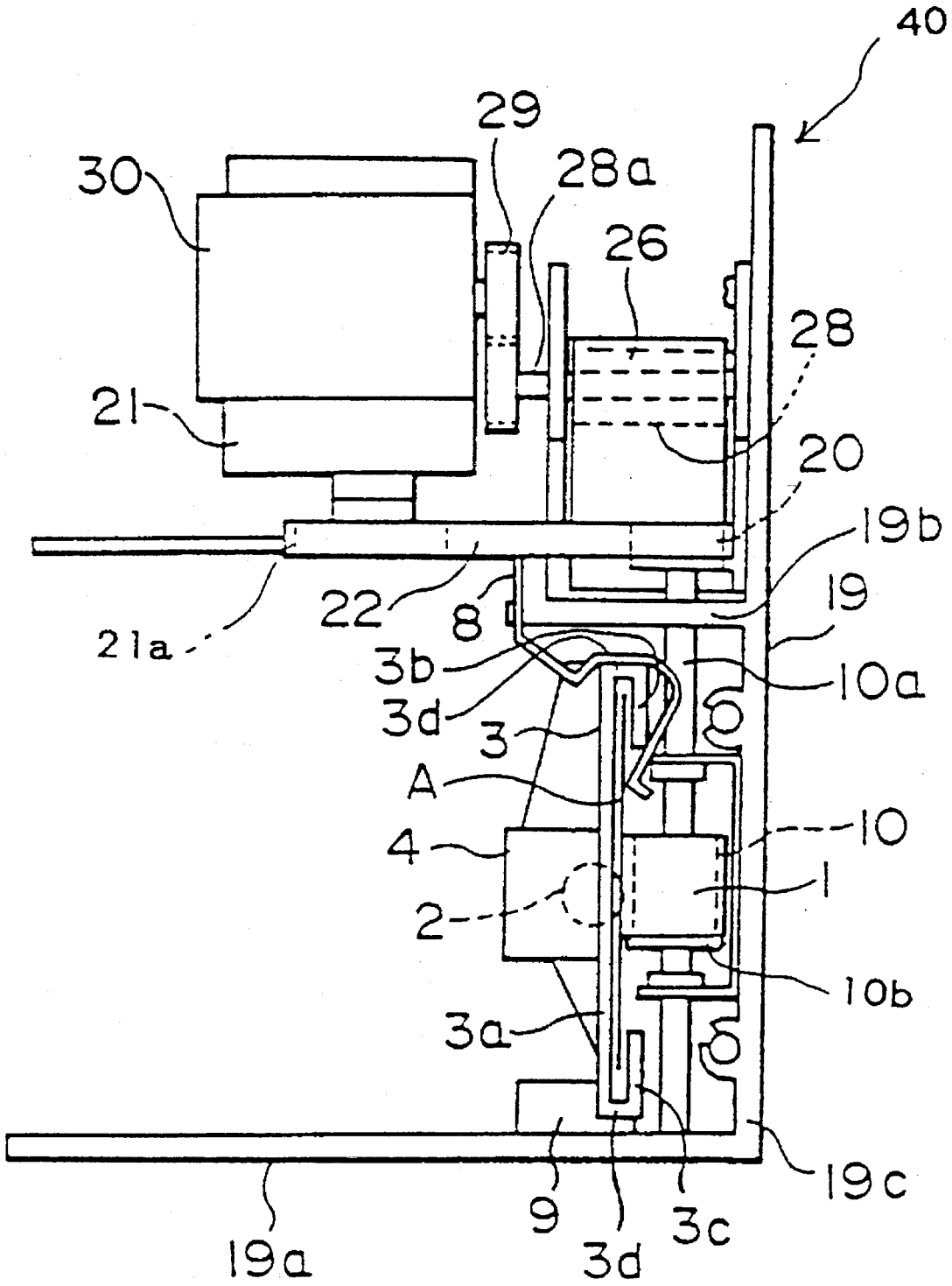
FIG. 2 is a side view of the bank note conveying unit according to the embodiment of the present invention.

As shown in FIG. 1 and FIG. 2, the conveying base 19 consists of a bottom board 19*a* which is in contact with the top board 16*a* of the unit support frame 16, an upright board 19*c* which stands up at the rear edge of the bottom board 19*a*, and a shelf board 19*b* provided at an intermediate portion of the upright board 19*c* in the vertical direction, and in parallel to the bottom board 19*a*.

The coin conveying device is provided at an upper portion of the shelf board 19*b* of the conveying base 19 The coin conveying device has a coin conveying endless belt 26, a drive pulley and a driven pulley between which the coin conveying endless belt is tensioned, rotary shafts 28*a*, 27*a* for each pulley 28, 27, a belt supporting member 33 which supports the endless belt 27 between the drive pulley 28 and the driven pulley 27, a coin conveying motor 30 for rotating the shaft 28*a* of the drive pulley, and a transmitting belt 29 which links the rotary shaft of the coin conveying motor 30 and the rotary shaft 28*a* of the drive pulley.

Figure 9:
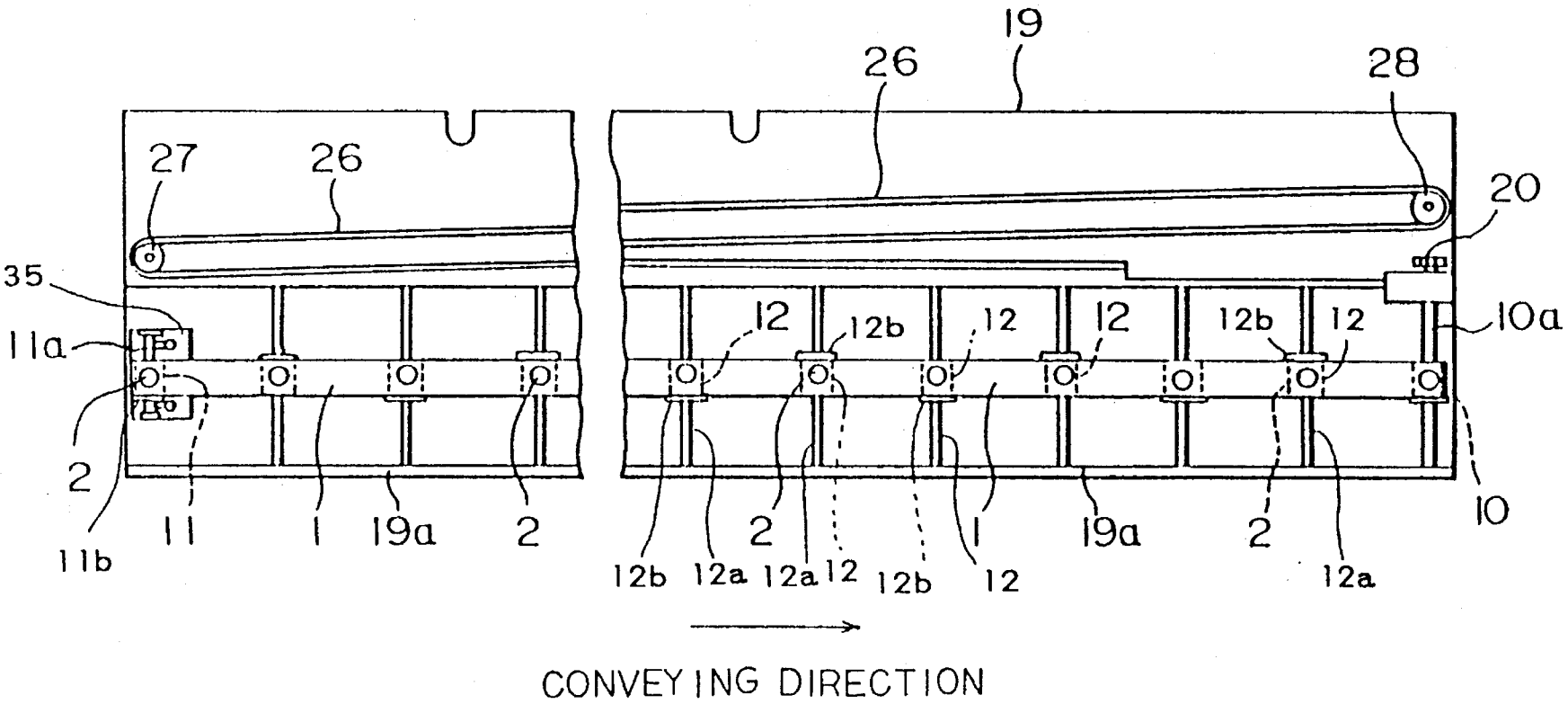
FIG. 9 is a front view of the conveying unit according to the embodiment of the present invention, in which, however, a belt driving mechanism and a bank note conveying path forming member are omitted.

The rotary shaft 28*a* of the drive pulley is equipped at one end portion of the upright board 19*c* through a bearing (not shown) so that the shaft may be perpendicular to the upright board 19*c* and horizontal. The rotary shaft 27*a* of the driven pulley is equipped at the other end portion of the upright board 19*c* through a bearing (not shown) and bearing fixing board 31 so that the shaft may be perpendicular to the upright board 19*c* and horizontal. The rotary shaft 27*a* of the driven pulley is equipped at a position, lower than the position of the rotary shaft 28*a* of the drive pulley. Therefore, as shown in FIG. 9, the drive pulley side is higher than the driven pulley side, so that the coin conveying belt is slanting. The bearing fixing board 31 to which the bearing for the rotary shaft 27*a* of the driven pulley is fixed, has an elongated hole 31*a* extending in the direction in which the coin conveying endless belt extends, and is fixed to the upright board 19*c* by a screw 32 which penetrates the hole 31*a*. Therefore, the bearing fixing board 31, as well as the bearing, the rotary shaft 27*a* of the driven pulley and the driven pulley can be moved in the direction in which the coin conveying belt extends.

The drive pulley 28 and the driven pulley 27 are both cylindrical and have a plurality of gear teeth on the respective outer peripheries. The coin conveying endless belt 26 has an outer periphery which is formed flat, and a plurality of teeth formed on the inner periphery so that the teeth may engage with the gear teeth of the drive pulley 28 and driven pulley 27. In FIG. 1, coins are placed on the flat outer periphery of a portion 26*a* of the coin conveying endless belt 26 which moves from the driven pulley 27 to drive pulley 27. (More specifically, the coins are placed on the portion of an upper part of the conveying endless belt with respect to the driven pulley 27 and drive pulley 28 (hereinafter be referred to as a coin loading portion.)

Figure 4:
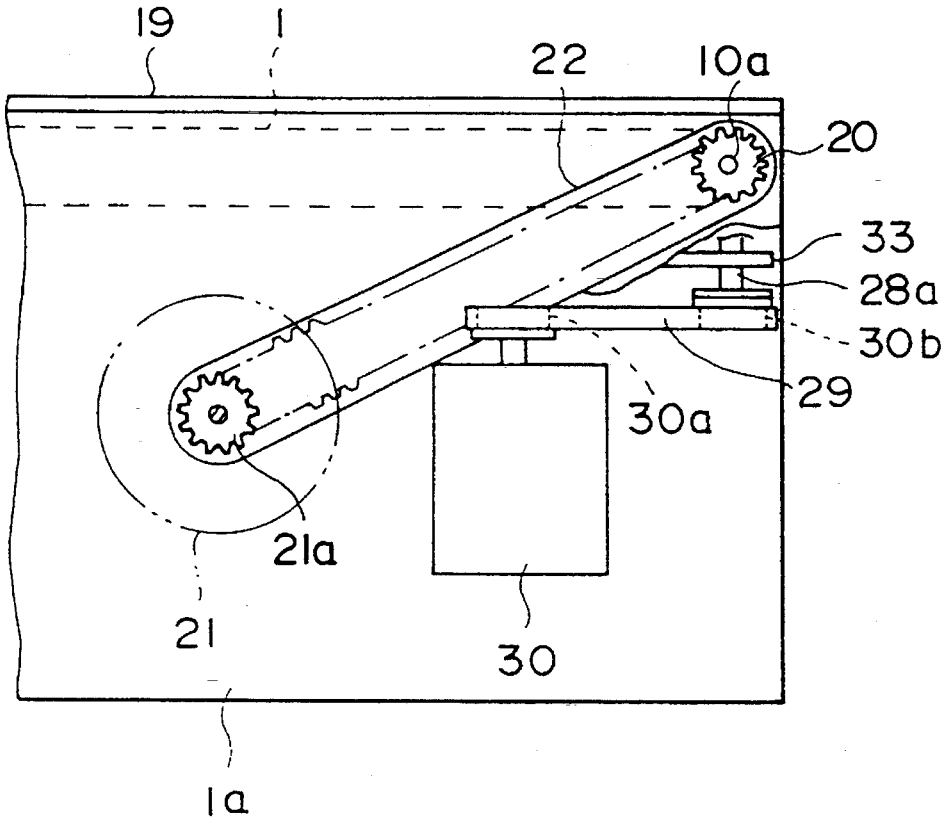
FIG. 4 is a top view of important elements of the bank note conveying unit according to an embodiment of the present invention.
Figure 5:
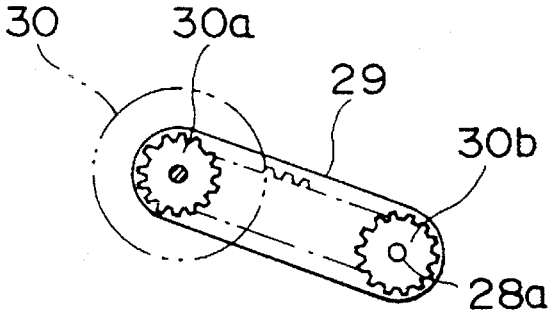
FIG. 5 is a front view of a transmitting belt for coin conveyance employable with the embodiment of the present invention.

As shown in FIGS. 4 and 5, a transmitting belt drive pulley 30*a* is provided on the rotary shaft of the coin conveying motor 30, and a transmitting belt driven pulley 30*b* is provided on the rotary shaft 28*a* of the drive pulley. The transmitting belt 29 is tensioned between the pulley 30*a* and 30*b*. On the outer periphery of each pulley 30*a*, 30*b*, a plurality of gear teeth are formed. On the other hand, on the inner periphery of the transmitting belt 29, a plurality of teeth are formed so that they may be engageable with the teeth of each pulley 30*a* and 30*b*.

Figure 3:
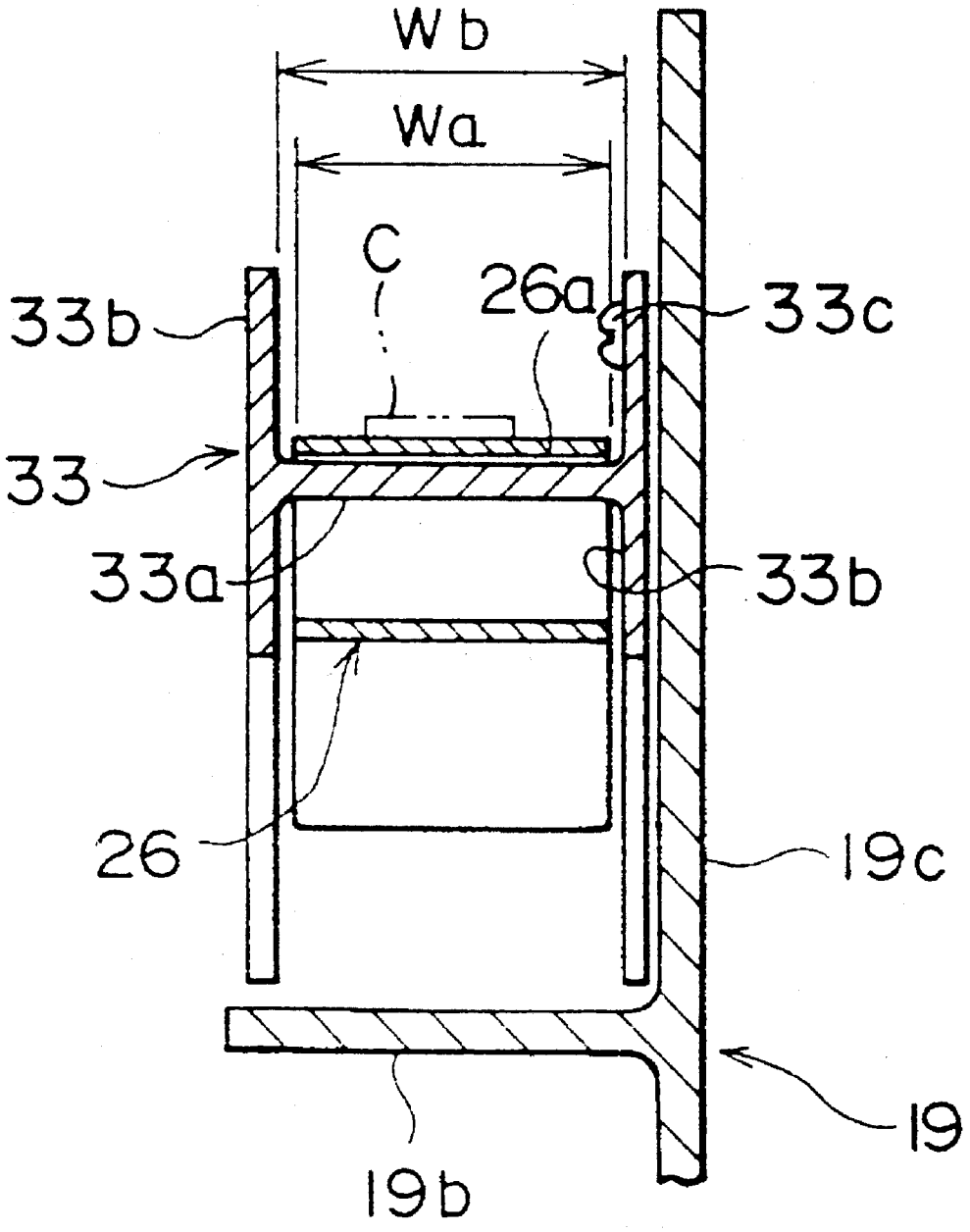
FIG. 3 is a cross sectional view of a coin conveying endless belt and a belt supporting member employable with the embodiment of the present invention.

As shown in FIG. 3, the belt supporting member 33 is formed in an H section and has two side portions 33*b*, 33*b* which are parallel to each other, and a support portion 33*a* formed between the two side portions. The distance between the two side portions, namely the width of the support portion 33*a* is slightly longer than the width Wa of the coin conveying belt 26. In the belt supporting member 33, the side portions 33*b*, 33*b* are parallel to the vertical direction and the support portion 33*a* is slanting from the higher side to the lower side, namely from the driving pulley 28 to the driven pulley 27, so that the coin loading portion of the coin conveying belt may be supported by the support portion 33*a* of the belt supporting member 33 at the under side thereof. The side portion 33*b* of the belt supporting member is fixed to the upright board 19*c* of the conveying base 19 by a screw 33*c*, thereby the belt supporting member 33 is fixed to the conveying base 19.

Although the coin distinguishing device is not shown in the drawings, is it disposed after the coin inserting slot 18 to distinguish whether the coin C inserted from the coin inserting slot 18 is genuine or fake, and feed the coin C, if it is determined to be genuine, to the coin loading portion 26*a* of the coin conveying belt 26 and then give instructions to the pachinko ball lending machine 14 to dispense a number of pachinko balls corresponding to the value of the coin C which was inserted.

As shown in FIGS. 1 and 2, the bank note conveying device is provided between the bottom board 19*a* and the shelf board 19*b* of the conveying base 19. The bank note conveying device conveys a bank note A with its surface being parallel to the vertical direction and the long side of the bank note A being almost parallel to the horizontal direction. The bank note conveying device is provided in parallel to the bank note conveying path forming member 3 and also parallel to the direction in which the pachinko game machine row extends. The bank note conveying device consists of a bank note conveying endless belt 1 which comes in contact with one of the major surfaces of a bank note A, a driven pulley 11 and a drive pulley 10, between which the bank note conveying endless belt 1 is tensioned, rotary shafts 10*a* and 11*a* of the pulleys 10 and 11, respectively a ball 2 which comes into contact with other major surface of the bank note A and presses it toward the bank note conveying endless belt 1, a holder 4 for rotatably supporting the ball 2, a belt supporting pulley 12 provided at the position opposing to the ball 2 with the bank note conveying endless belt therebetween (shown in FIGS. 6 and 8), and a belt drive mechanism for rotating the rotary shaft 12*a* for the belt supporting pulley 12 and the drive pulley 10.

Figure 6:
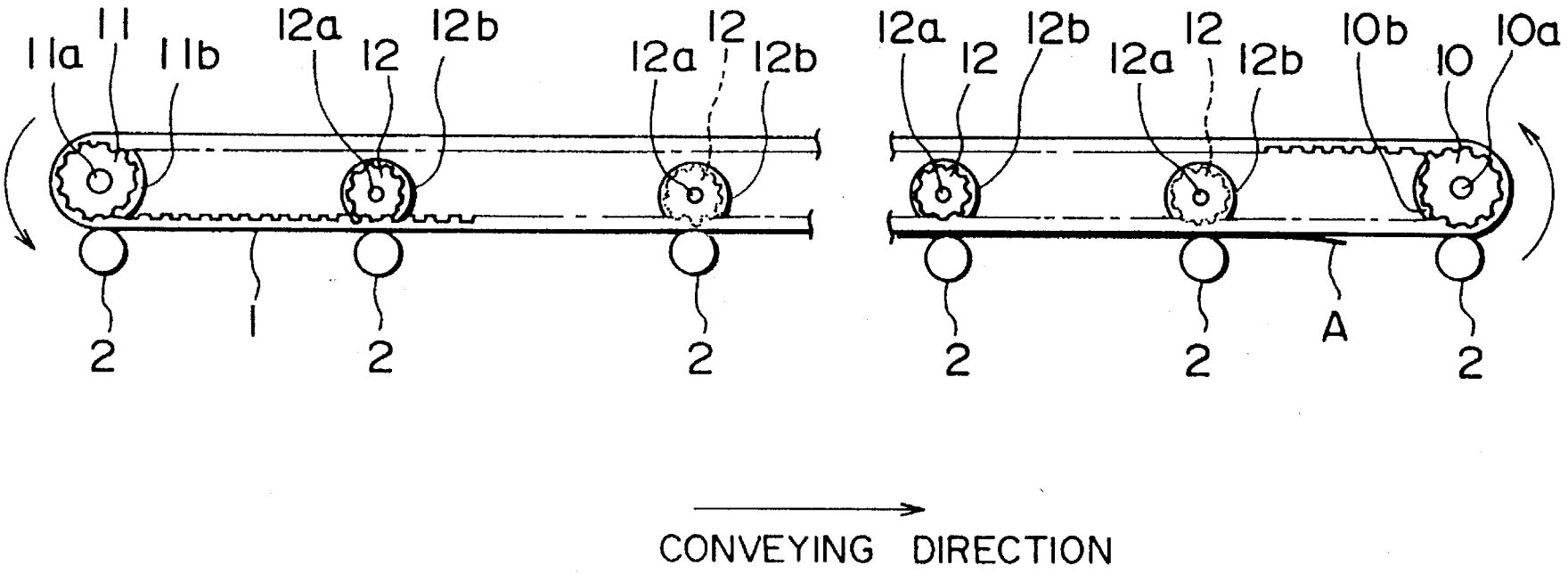
FIG. 6 is a top view of a bank note conveying belt and pulleys employable in the embodiment of the present invention.
Figure 7:
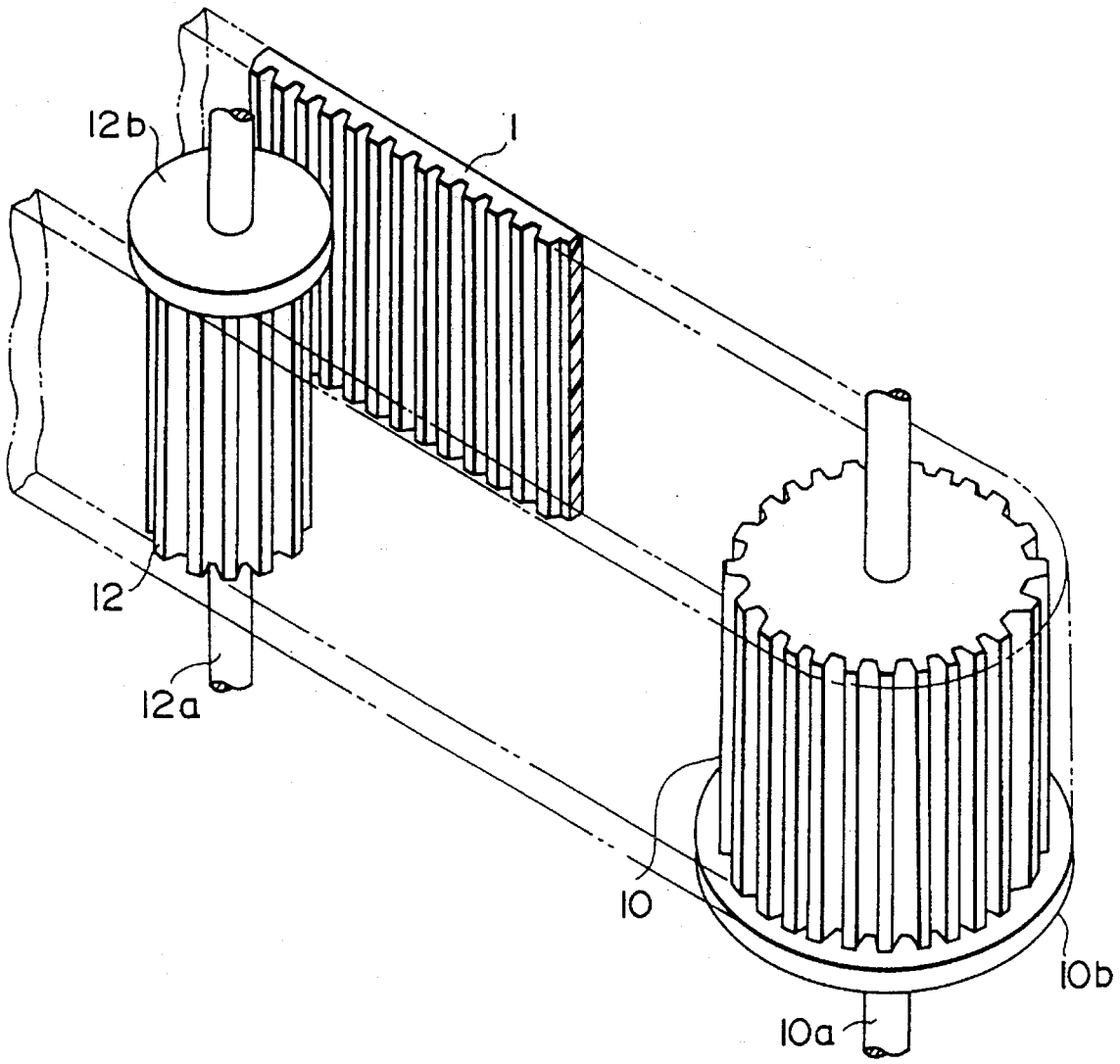
FIG. 7 is a perspective view of the bank note conveying belt, drive pulley and the belt supporting pulley according to the embodiment of the present invention.

The rotary shaft 10*a* of the drive pulley is fixed to an end portion of the backboard 19*c* through a bearing (not shown) to extend in a vertical direction. The rotary shaft 11*a* of driven pulley is also fixed to the other end portion of the backboard 19*c* through a bearing 37 and a bearing fixing board 35 in a vertical direction. The bearing fixing board 35 has a long elongated hole 35*a* extending in the direction in which the bank note conveying endless belt extends, and is fixed to the upright board 19*c* by a screw 36 which penetrates into the hole 35*a*. Therefore, the bearing, fixing board 35 the bearing 37 the rotary shaft of the driver, pulley 11*a*, and the driven pulley 11, are movable in the direction in which the bank note conveying belt 1 extends. The rotary shaft of the belt supporting pulley 12*a* is also fixed to the conveying base 19 through a bearing (not shown) extending vertically. As shown in FIGS. 6 and 7, each of the pulleys 10, 11, 12 is cylindrical and has a plurality of gear teeth formed on the outer periphery thereof. Also each of the rotary shafts 10*a*, 11*a*, 12*a* for each pulley 10,11, 12 has a flange 10*b*, 11*b*, 12*b*, respectively, for preventing the belt from slipping off, which is formed at either one of the end portions of the shaft in the direction to which it extends. To be more precise, the flange 10*b*, and 11*b* for the drive pulley 10 and the driven pulley 11 respectively are formed at the lower end portions of each pulleys 10 and 11, while the flanges 12*b* for the plurality of belt supporting pulleys 12 are formed alternately on an upper end portion and a lower end portion. Namely as shown in FIG. 9, the flange is formed, if seen from the drive pulley side, first at the lower end portion of the pulley, then at the upper end portion of the next pulley, again at the lower end portion of the third pulley, the upper end portion of the next pulley . . . and so on. The outside diameters of these flanges 10*b*, 11*b*, 12*b* are larger than those of the pulleys 10, 11, 12 respectively, so that the end portion of the bank note conveying belt 1 in its width direction may contact the flanges in order to regulate the position of the bank note conveying belt 1 with respect to the width direction. The bank note conveying belt 1 has a flat outside periphery (which the bank note A comes into contact), but the inner periphery has a plurality of teeth which are engageable with the gear teeth of the pulleys 10, 11 and 12.

As shown in FIG. 2, the bank note conveying path forming member 3 has a front side guide portion 3*a* which comes into contact with one of the major surfaces of the bank note A, an upper rear side guide portion 3*b* which comes in contact with another major surface of the bank note A at its upper portion, a lower rear side guide portion 3*c* which comes in contact with said another major surface of the bank note A at its lower portion an widthwise-position guide section which determines the position of the bank note vertically, namely, the position of the bank note A in the width direction thereof. In this embodiment, as the bank note A is conveyed with its major surface parallel to the vertical direction, the front side guide portion 3*a* and each of the rear side guide portions 3*b*, 3*c* extend vertically. The bank note conveying belt 1 faces the front side guide portion 3*a* and is disposed between the upper rear side guide portion 3*b* and the lower rear side guide portion 3*b*. In the center of the front guide portion 3*a*, a circular opening (not shown) is formed. The opening is formed in such a manner that the opening has a diameter slightly smaller than that of the ball 2 so that a part of the ball 2 may project through the opening but the ball may not completely project through the opening. At the front side of the front side guide portion 3*a*, i.e. at the side opposite to the bank note conveying belt 1, the holder 4 for rotatably supporting the ball 2 is provided.

The upper portion of the bank note conveying path forming member 3 is supported by a plate spring, and the lower portion is supported by the path forming member fastener 9. One end portion of the plate spring 8 is fixed to the shelf board 19*b* of the conveying base 19, and the other end portion is formed in a shape which is removably engageable with the upper portion of the bank note conveying path forming member 3. The bank note conveying path forming member 3 is displaceably supported by the plate spring 8 and the path forming member fastener 9 between two states: a state for conveyance in which the front side guide member 3*a* faces the bank note conveying belt 1, and a state for repair in which the upper portion of the bank note conveying member 1 swing down around a lower portion toward the front side.

Figure 8:
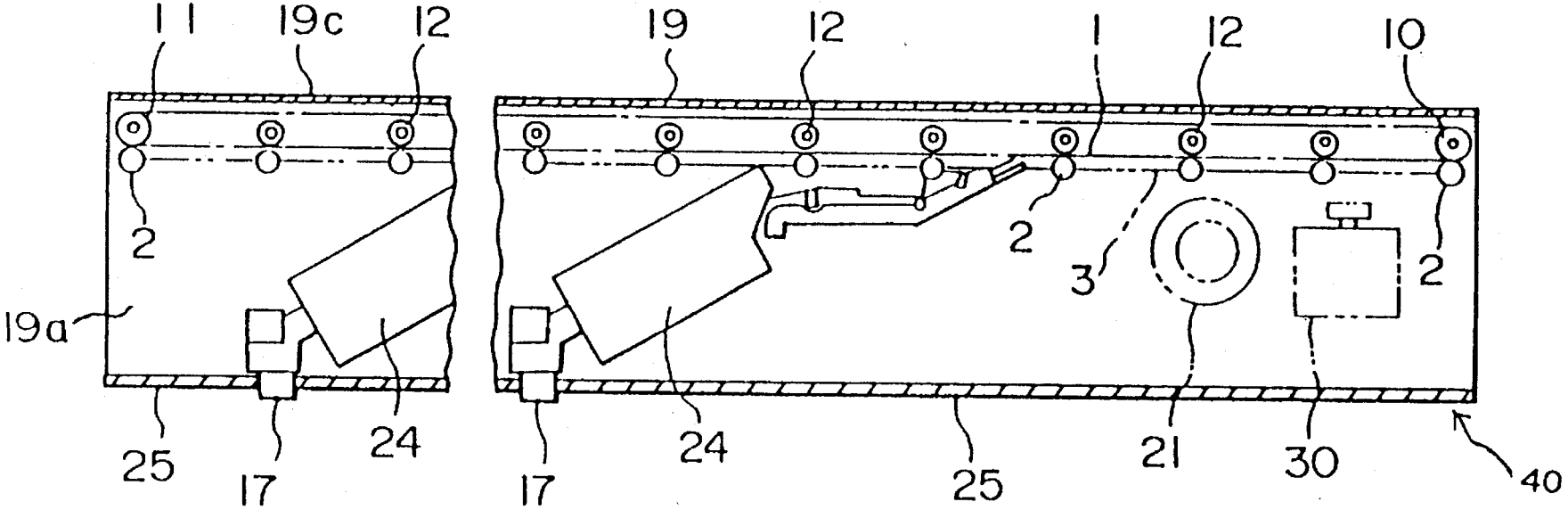
FIG. 8 is a top view of the conveying unit according to the embodiment of the present invention in which, however, a coin conveying device and a bank note conveying path forming member are omitted.

As shown in FIG. 1, FIG. 2 and FIG. 4, the belt driving mechanism includes a bank note conveying motor 21 for rotating the rotary shaft 10*a* of the drive pulley, and a transmitting belt drive pulley 21*a* to be fixed to the rotary shaft of the bank note conveying motor 21, a transmitting belt driven pulley 20 to be fixed to the drive pulley rotary shaft 10*a*, and a transmitting belt 22 to be tensioned between these pulleys 21*a* and 20*a*. The belt drive mechanism for bank note conveying device is provided at the upper section of the shelf board 19*b* of the conveying base 19. As shown in FIG. 8, the bank note distinguishing device 24 determines whether the bank note A inserted into the bank note insertion slot is genuine or fake, and feeds only a genuine bank note into the space between the belt 1 and the ball 2, and at the same time gives an instruction to the pachinko ball lending machine 14 to dispense the number of pachinko balls which corresponds to the value of the bank note inserted.

Next, the operation of the pachinko game island will be explained according to the embodiment of the present invention.

When a bank note A is inserted into the bank note insertion slot 17, the bank note distinguishing device determines whether it is genuine or not. When the bank note distinguishing device determines that the bank note A is genuine, the bank note A is supplied to the bank note conveying device while giving an instruction to the pachinko ball lending machine to dispense a certain number of pachinko balls which corresponds to the value of the bank note A. The pachinko ball lending machine 14 dispenses the predetermined number of pachinko balls to the pachinko ball dispensing slot (shown in FIG. 11 and FIG. 12).

The bank note from the bank note distinguishing device 24 is fed to the bank note conveying path formed by the bank note conveying path forming member 3 of the bank note conveying device. One of the major surfaces of the bank note A contacts the bank note conveying belt 1 and the other major surface contacts the ball 2. The bank note A is conveyed according to the rotation of the bank note conveying belt while being held between the ball 2 and the bank note conveying belt 1.

The bank note A is conveyed by the bank note conveying device in the conveying unit 40, which is provided for each unit consisting of two pachinko game machines 13, 13 and two pachinko ball lending machines 14 and 14, to the end of the conveying unit 40. The bank note is transmitted to the conveying device in the next adjacent conveying unit 40, and thus, it is finally conveyed to the money exchange **15*b* in the island decoration 15*a*** provided at the end of the pachinko game island B.

In the embodiment of the present invention, a plurality of gear teeth are formed on the outer periphery of each of the pulleys **21*a*, 20 between which the transmitting belt 22 for the bank note conveying device is tensioned. A plurality of teeth are also formed in the inner periphery of the transmitting belt 22 so that they are engageable with those of the pulleys 21*a*, and 20. Therefore the rotating force of the bank note conveying motor 21 can be transmitted to the drive pulley 10 without any power loss. Furthermore, as a plurality of gear teeth are formed on the outer periphery of the pulleys 10, 11, 12 on which the bank note conveying belt is provided, and also a plurality of teeth which are engageable with those of pulleys 10, 11, 12, are formed on the inner periphery of the bank note conveying belt 1, the rotating force of the drive pulley 10 can be transmitted to the bank note conveying belt 1 without any power loss. Accordingly, the rotating force of the drive pulley 10 can be transmitted to the bank note conveying belt 1** without any power loss, and effective conveyance of the bank note is attainable.

In addition, in the present embodiment, as each of the pulleys 10, 11, 12 has a flange **10*b*, 11*b*, 12*b* at respective end portion, the bank note conveying belt is prevented from coming off from each of the pulley 10, 11, 12. However as shown in the embodiment of the present invention, if the flanges 10*b*, 11*b*, 12*b* are formed only at respective one end portion of pulleys 10, 11, 12, it is preferable that the flanges are formed at the top end and at the lower end alternately so that the conveying belt is prevented from coming off in either of upper and lower directions. It is also preferable to provide flanges at both ends of the pulley. In such a case, the bank note conveying belt will not easily be unfastened. Therefore, either one of the drive pulley 10 or driven pulley 11** should be movable toward the other pulley so that the bank note conveying belt may be made slack to be removed.

When a coin C is inserted into the coin insertion slot 18, the coin distinguishing device (not shown) determines whether the coin is genuine or fake. If the coin distinguishing device determines that the coin is genuine, it feeds the coin to the coin conveying device while giving an instruction to the pachinko ball lending machine 14 to dispense a number of pachinko balls which corresponds to the value of the coin. The pachinko ball lending machine 14 dispenses a predetermined number of pachinko balls from the pachinko ball dispensing slot **14*a***.

The coin C fed from the coin distinguishing device is loaded on the coin loading portion **26*a* of the coin conveying belt 26. The coin C on the coin conveying belt 26 is conveyed according to the rotation of the coin conveying belt 26. As the coin C is much heavier than the bank note A, the coin conveying belt cannot stand by itself the weight of the coin C, and the conveying belt would become slack. Especially, in the intermediate portion between the drive pulley 28 and the driven pulley 27, the amount of slack would be very large, and might cause difficulty in the conveyance of the coin. Therefore, in the embodiment, the coin loading portion 26*a* is supported by the support plate 33 of the belt support member upwardly from under the coin loading portion 26*a*. Also in the embodiment of the present invention, the side portions 33*b*, 33*b* of the belt support member 33 restrict the position of the coin C in the widthwise direction of the coin conveying belt 26, so that the coin C may not fall from the coin loading portion 26*a* of the coin conveying belt 26 in the widthwise direction. Although in the embodiment of the present invention, "H sections" are employed for the belt supporting member, channels may alternatively be employed to obtain the same effect. In this case, the coin conveying belt 26 is placed at the channel bottom. For a belt supporting member, a roller may alternatively be used which will reduce the frictional resistance to the belt 26**, if only the belt supporting function is necessary and the function of restricting the position of the coin C is not pursued.

When the coin C is conveyed to the end of the conveying unit 40, the coin is transmitted to the coin conveying device in the next conveying unit, and thus finally, conveyed to the money exchange **15*d* in the island decoration 15*a*** provided in the end of the pachinko game island B.

In the embodiment of the present invention, the coin conveying device, similarly to the bank note conveying device, has pulleys **30*a*, 30*b*, 27, 28, each having a plurality of gear teeth formed on the outer periphery thereof, and the belts 29, 26 having a plurality of teeth formed on the inner periphery, which are engageable with those of the pulleys 30*a*, 30*b*, 27, 28. Because of this construction, the rotation force of the coin conveying motor 30 can be transmitted to the coin conveying belt 26** without any power loss.

What is claimed is:

1. A bank note conveying device comprising:

an endless belt having a flat outer periphery for contacting one of the major faces of a bank note to be conveyed and an inner periphery having a plurality of teeth formed thereon;

a drive pulley and a driven pulley, both being cylindrical and having a plurality of gear teeth formed on their respective outer peripheries so that they may engage said plurality of teeth of said endless belt;

said endless belt being tensioned between said drive pulley and said driven pulley;

a rotary shaft penetrating the center of each of said cylindrical pulleys;

a belt driving mechanism for rotating said rotary shaft of said drive pulley;

a plurality of balls which are spaced along said endless belt for contacting another major face of the bank note to be conveyed;

ball holders for respectively rotatably supporting each of said balls;

a plurality of cylindrical belt supporting pulleys, each having a plurality of gear teeth formed on an outer periphery thereof so that they may be engageable with said plurality of teeth of said endless belt, said pulleys being respectively disposed at positions opposing said plurality of said balls with said endless belt therebetween; and a plurality of rotary shafts for rotatably supporting said plurality of belt supporting pulleys, respectively;

wherein each of said cylindrical drive pulley, said cylindrical driven pulley, and said plurality of cylindrical belt supporting pulleys have a pair of end portions, some of the pulleys having a flange at only one end portion thereof, others of the pulleys having a flange at only another end portion thereof, each of said flanges having a larger outer diameter than that of the associated pulley.

2. A bank note conveying device according to claim 1, wherein said drive pulley and said driven pulley each have a flange having a larger outer diameter than that of the respective pulley and provided on at least one end portion thereof.

3. A bank note conveying device according to claim 2, said belt driving mechanism further comprising:

a bank note conveying motor having a rotary shaft;

a transmitting belt drive pulley cylindrically formed around said rotary shaft of said bank note conveying motor, with said rotary shaft as its center axis, said transmitting belt drive pulley being fixed to said rotary shaft of said bank note conveying motor and having a plurality of gear teeth formed on the outer periphery, a transmitting belt driven pulley cylindrically formed around said rotary shaft of said drive pulley with said rotary shaft as its center axis, said transmitting belt driven pulley being fixed to said rotary shaft of said drive pulley and having a plurality of gear teeth formed on the outer periphery; and a transmitting belt having a plurality of teeth formed on the inner periphery and being tensioned between said transmitting belt drive pulley and said transmitting belt driven pulley, said plurality of teeth being engageable with said plurality of gear teeth of said transmitting belt drive pulley and said plurality of gear teeth of said transmitting belt driven pulley.

4. A bank note conveying device according to claim 1, said belt driving mechanism further comprising:

a bank note conveying motor having a rotary shaft;

a transmitting belt drive pulley cylindrically formed around said rotary shaft of said bank note conveying motor, with said rotary shaft as its center axis, said transmitting belt drive pulley being fixed to said rotary shaft of said bank note conveying motor and having a plurality of gear teeth formed on the outer periphery, a transmitting belt driven pulley cylindrically formed around said rotary shaft of said drive pulley with said rotary shaft as its center axis, said transmitting belt driven pulley being fixed to said rotary shaft of said drive pulley and having a plurality of gear teeth formed on the outer periphery; and a transmitting belt having a plurality of teeth formed on the inner periphery and being tensioned between said transmitting belt drive pulley and said transmitting belt driven pulley, said plurality of teeth being engageable with said plurality of gear teeth of said transmitting belt drive pulley and said plurality of gear teeth of said transmitting belt driven pulley.

* * * * *